US007740565B2

(12) United States Patent
Chen

(10) Patent No.: US 7,740,565 B2
(45) Date of Patent: Jun. 22, 2010

(54) COMPACT DRIVING AND RESISTANCE DEVICE FOR STATIONARY BIKES

(76) Inventor: Yi-Yen Chen, 1F., No. 1176, Sec. 2, Wu-Chuan W. Rd., Nan-Tun Dist., Taichung City (TW)

( * ) Notice: Subject to any disclaimer, the term of this patent is extended or adjusted under 35 U.S.C. 154(b) by 194 days.

(21) Appl. No.: 12/076,287

(22) Filed: Mar. 17, 2008

(65) Prior Publication Data

US 2009/0149300 A1 Jun. 11, 2009

(30) Foreign Application Priority Data

Dec. 6, 2007 (TW) ..... 96146562 A

(51) Int. Cl.
*A63B 22/06* (2006.01)

(52) U.S. Cl. ..... 482/63; 482/57

(58) Field of Classification Search ..... 482/57, 482/63

See application file for complete search history.

(56) References Cited

U.S. PATENT DOCUMENTS 4,752,066 A * 6/1988 Housayama ..... 482/63
4,775,145 A * 10/1988 Tsuyama ..... 482/63
4,822,032 A * 4/1989 Whitmore et al. ..... 482/63
5,433,680 A * 7/1995 Knudsen ..... 482/57
6,234,939 B1 * 5/2001 Moser et al. ..... 482/63
6,475,122 B2 * 11/2002 Wu ..... 482/57
6,821,236 B2 * 11/2004 Liang ..... 482/138
7,029,424 B2 * 4/2006 Chen ..... 482/63
2003/0153436 A1 * 8/2003 Ho ..... 482/63
2007/0232465 A1 * 10/2007 Puzey ..... 482/110

* cited by examiner

*Primary Examiner*—Fenn C Mathew
*Assistant Examiner*—Andrew M Tecco

(57) ABSTRACT

A driving and resistance device for stationary bikes includes a frame including two boards between which a flywheel is located, a shaft extends through the flywheel and the two boards. A driving wheel is mounted to the shaft and drives the flywheel. The driving unit includes a first belt, a second belt, an idle wheel unit, an intermediate wheel unit and a passive wheel, the passive wheel is connected to a sleeve which is secured to the shaft. The driving wheel is driven by rotating the cranks on two ends of the shaft and the first belt, the intermediate wheel unit, the second belt, the passive wheel, the sleeve and the flywheel are driven in sequence. Because the driving wheel and the flywheel share the same shaft so that the driving and resistance device is compact.

10 Claims, 8 Drawing Sheets

SECTION:a-a

COMPACT DRIVING AND RESISTANCE DEVICE FOR STATIONARY BIKES

FIELD OF THE INVENTION

The present invention relates to a compact driving and resistance device for stationary bikes, wherein the flywheel and the magnetic resistance wheel share a common shaft so as to reduce space required.

BACKGROUND OF THE INVENTION

A conventional stationary bike 6 is shown in FIG. 7 and generally includes a frame 62 with a driving device 61 connected thereto and the driving device 61 includes a driving wheel 611 mounted on a first shaft 621 and a flywheel 63 is connected with a second shaft 623. A belt 612 is connected between the driving wheel 611 and the flywheel 63. Two cranks 622 are connected to two ends of the first shaft 621 and are rotated by the user to drive the driving wheel 611. Some stationary bikes include a magnetic resistance device 64 and/or an electric power generation device 65. The magnetic resistance device 64 generates a resistance force to the flywheel 63 to provide the exercise purpose. The power generation device 65 includes a stator 652 and permanent magnets 651 which move relative to the stator 652 to generate electric power which powers the control panel 66 and the magnetic resistance device 64.

The driving device 61, the flywheel 63, the magnetic resistance device 64 and the power generation device 65 have to be installed to the frame of the stationary bike 6 according the profile and shape of the frame, this requires a lot of time and skilled persons. Besides, the first and second shafts 621, 623 require a large space so that the stationary bikes are bulky and occupy large transportation space.

The present invention intends to provide a compact driving and resistance device for stationary bikes, the flywheel and the magnetic resistance wheel share a common shaft so that the stationary bikes can be compact and the assembly time can be reduced.

SUMMARY OF THE INVENTION

The present invention relates to a driving and resistance device for stationary bikes and the device comprises a frame including two boards and a shaft extends through the two boards. Two cranks are connected to two ends of the shaft and a flywheel is connected to the shaft. A driving unit includes a driving wheel mounted to the shaft and drives the flywheel. The driving unit further includes a first belt, a second belt, an idle wheel unit, an intermediate wheel unit and a passive wheel. The passive wheel is connected to a sleeve which is secured to the shaft in a first direction. The driving wheel is driven by rotating the cranks and the first belt, the intermediate wheel unit, the second belt, the passive wheel, the sleeve and the flywheel are driven in sequence.

The primary object of the present invention is to provide a driving and resistance device for stationary bikes wherein the flywheel and the driving wheel shares the same shaft so that the driving and resistance device is compact.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
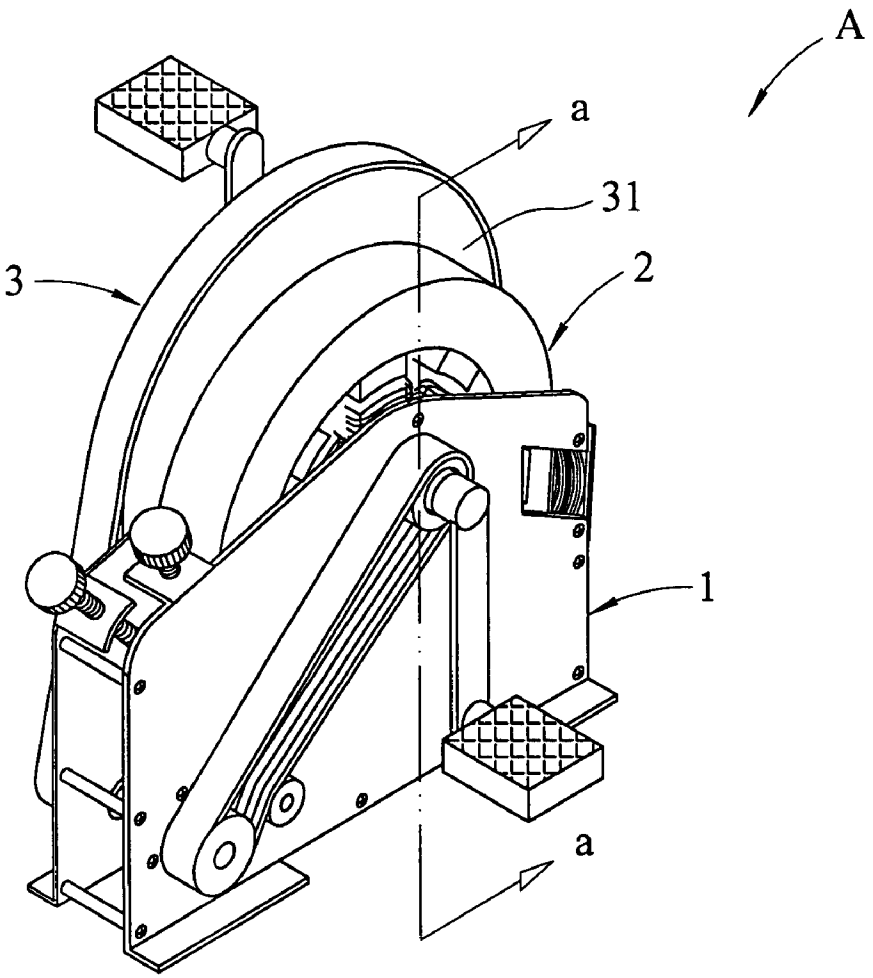
FIG. 1 is a perspective view to show the driving and resistance device for stationary bikes of the present invention.
Figure 2:
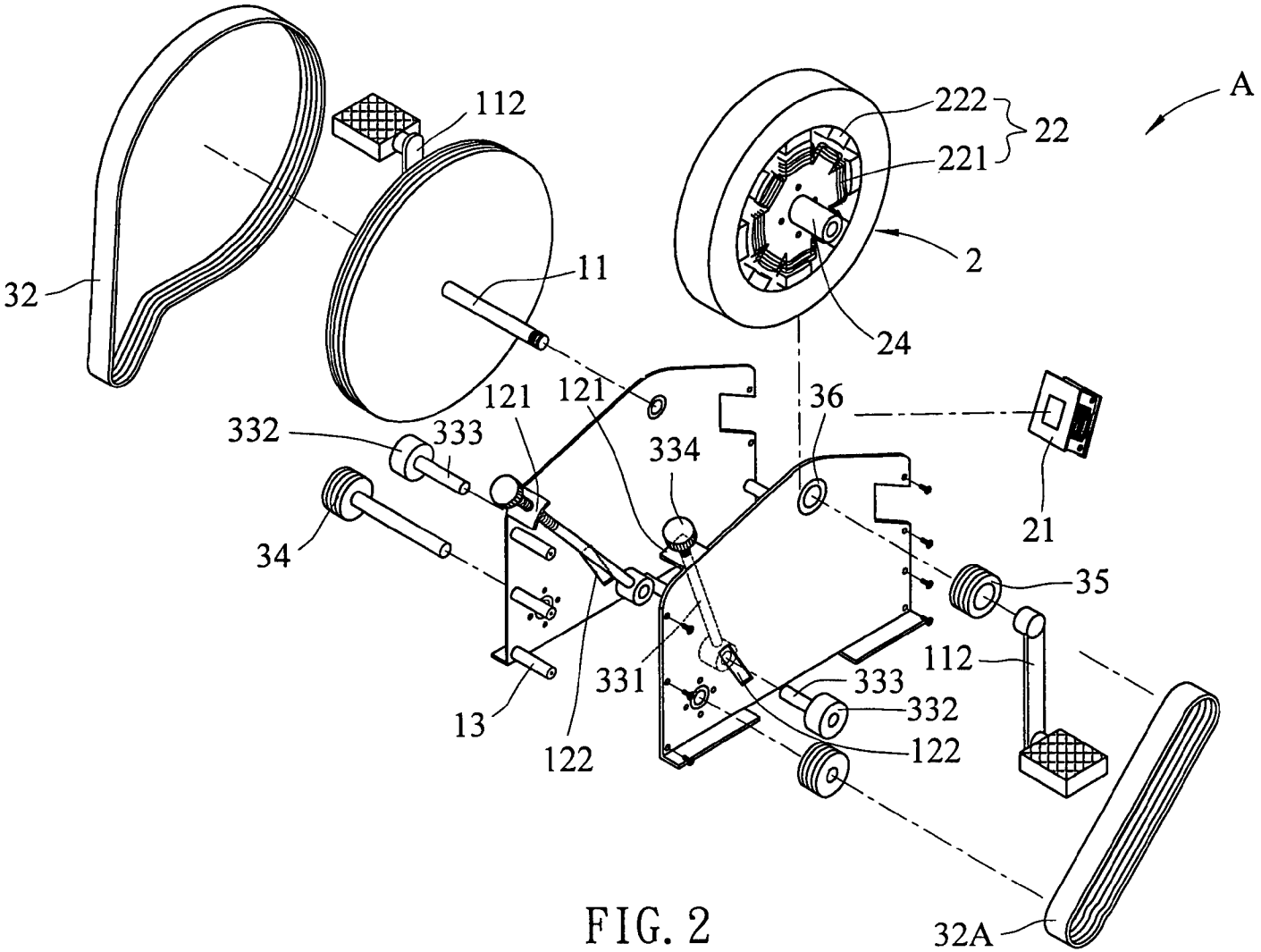
FIG. 2 is an exploded view to show driving and resistance device for stationary bikes of the present invention.
Figure 3:
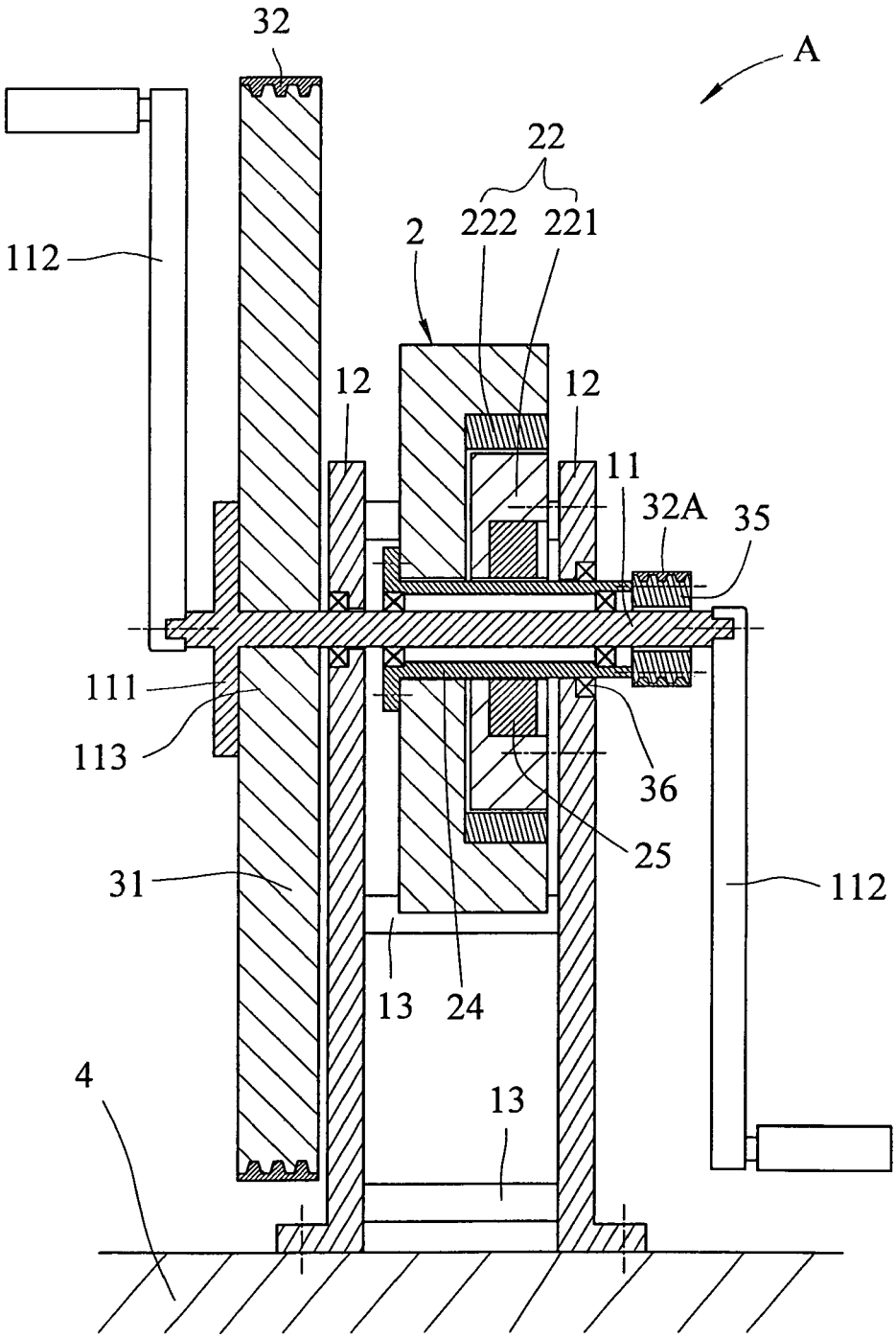
FIG. 3 is a side cross section view taken along line a-a in FIG. 1.
Figure 4:
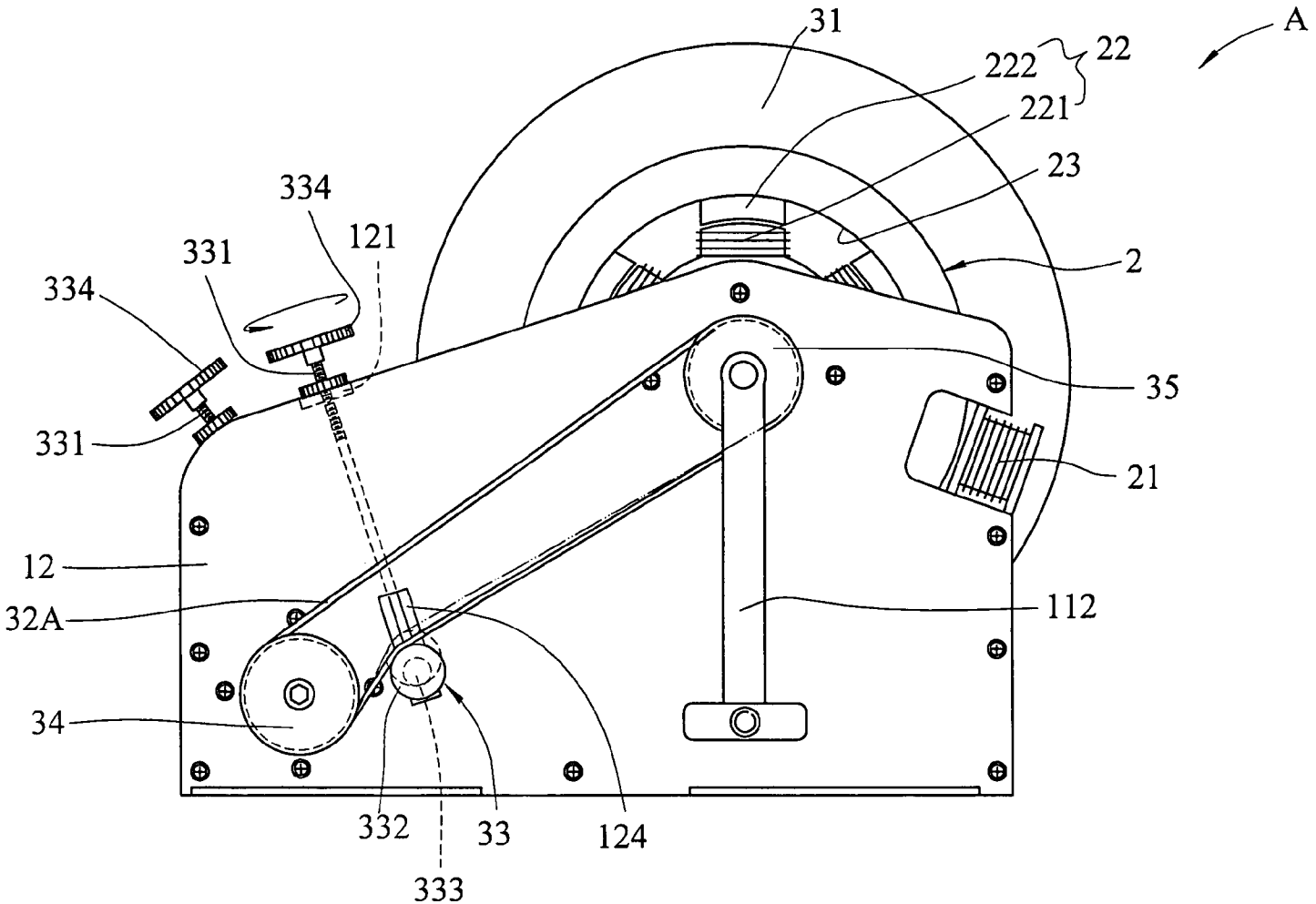
FIG. 4 is a side view to show one side of the driving and resistance device for stationary bikes of the present invention.
Figure 5:
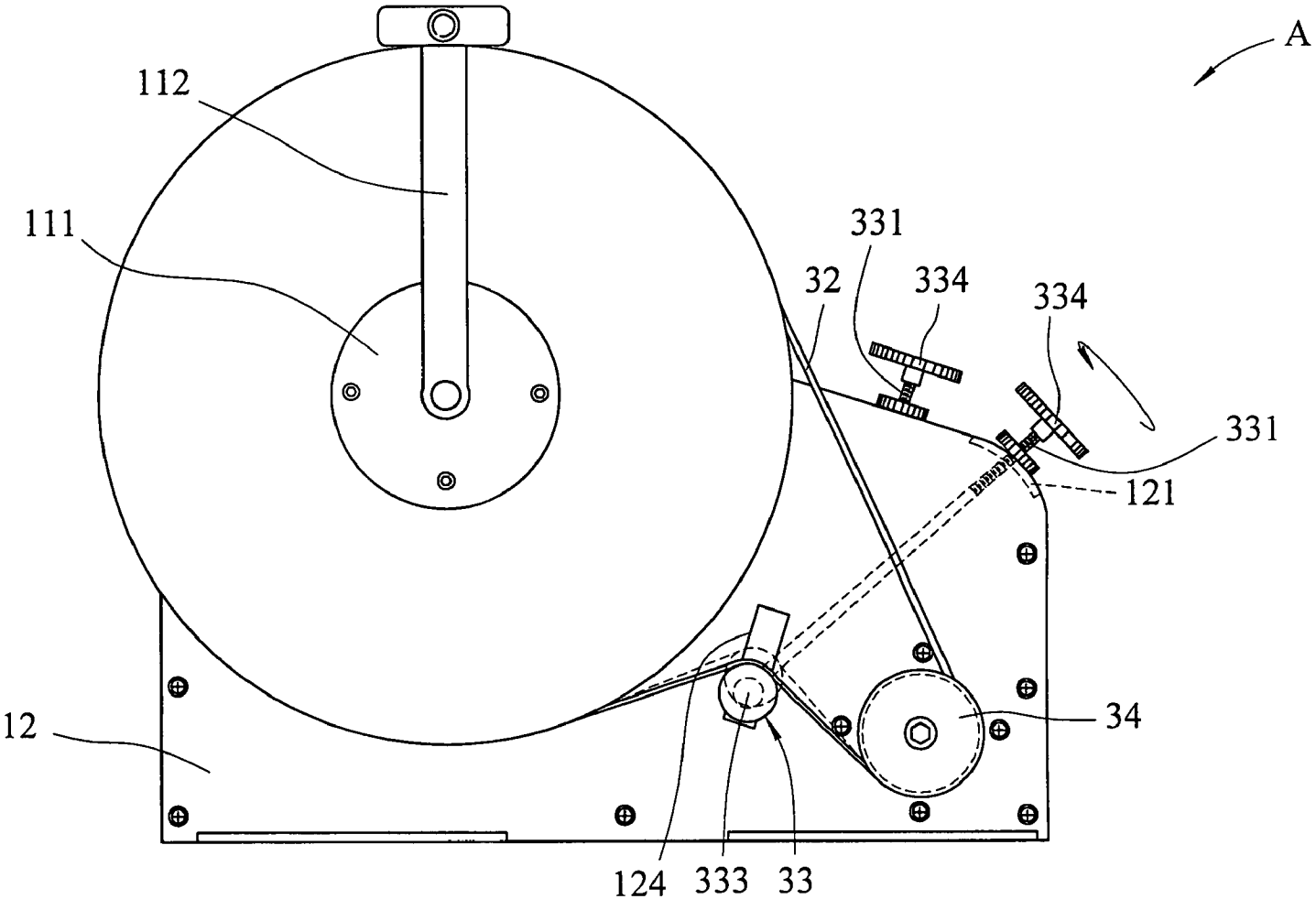
FIG. 5 is a side view to show the other side of the driving and resistance device for stationary bikes of the present invention.

Referring to FIGS. 2 to 6, the driving and resistance device "A" for stationary bikes of the present invention comprises a frame 1 including two boards 12 between which a plurality of separation tubes 13 are connected so as to define a space therebetween. A shaft 11 extends through the two boards 12 and two cranks 112 are connected to two ends of the shaft 11. A disk 111 is connected to one end of the shaft 11 and outside of the frame 1. A flywheel 2 is connected to the shaft 11 with a bearing located between one of the boards 12 and the shaft 11.

A driving unit 3 includes a driving wheel 31 mounted to the shaft 11 and is located outside of the frame 1, the driving wheel 31 is mounted to the shaft 11 and located between the disk 111 and one of the boards 12. The driving unit 3 further includes a first belt 32, a second belt 32A, an idle wheel unit 33, an intermediate wheel unit 34 and a passive wheel 35. The sleeve 24 extends through the flywheel 2 and the other board 12, a bearing 36 is located between the outside of the sleeve 24 and the hole in the board 12. The flywheel 2 is fixedly mounted to the sleeve 24. A one-way bearing 25 is located between the flywheel 2 and the shaft 11 such that the flywheel 2 can only rotate in a first direction.

An electric power generation device 22 is located in the flywheel 2 and activated when the flywheel 2 rotates. The electric power generation device 22 includes a stator 221 and a plurality of permanent magnets 222, the stator 221 is fixed to the frame 1 and the permanent magnets 222 are located in a recess 23 in the flywheel 2. When the flywheel 2 rotates, the sleeve 24 fixed to the flywheel 2 rotates about the stator 221 so as to generate electric power to power the control panel of the stationary bike.

The passive wheel 35 is connected to the sleeve 24 and the driving wheel 31 is driven by rotating the cranks 112 and the first belt 32, the intermediate wheel unit 34, the second belt 32A, the passive wheel 35, the sleeve 24 and the flywheel 2 are driven in sequence. A magnetic resistance device 21 is connected to the frame 1 and located beside the flywheel 2 so as to provide magnetic resistance force to the flywheel 2.

The idle wheel unit 33 includes two adjustment rods 331, two idle wheels 332 and two side rods 333, wherein the two adjustment rods 333 extend through two extensions 121 extending from the two boards 12 and are connected to the two idle wheels 332. The two idle wheels 332 include two axes 333 which movably extend through slots 122 defined through the two boards 12 and the two axes 333 are connected to the two adjustment rods 331 respectively. The protrusions 121 each have a threaded hole and the adjustment rods 331 are threadedly connected to the threaded holes. Each adjustment rod 331 has an adjustment disk 334 on a top end thereof so that when rotating the adjustment disks 334, the idle wheels 332 are moved along the slots 122. The idle wheels 332 press the first belt 32 or the second belt 32A such that the user may adjust the tension of the first belt 32 or the second belt 32A by rotating the adjustment disks 334.

The flywheel 2 and the driving wheel 31 use the same shaft 11 so that the space occupied by the driving and resistance device "A" can be reduced, the flywheel 2 and the driving wheel 31 are located in parallel to each other. The driving and resistance device "A" can be made in mass production and as a module which can be easily installed to different types of stationary bikes.

Figure 6:
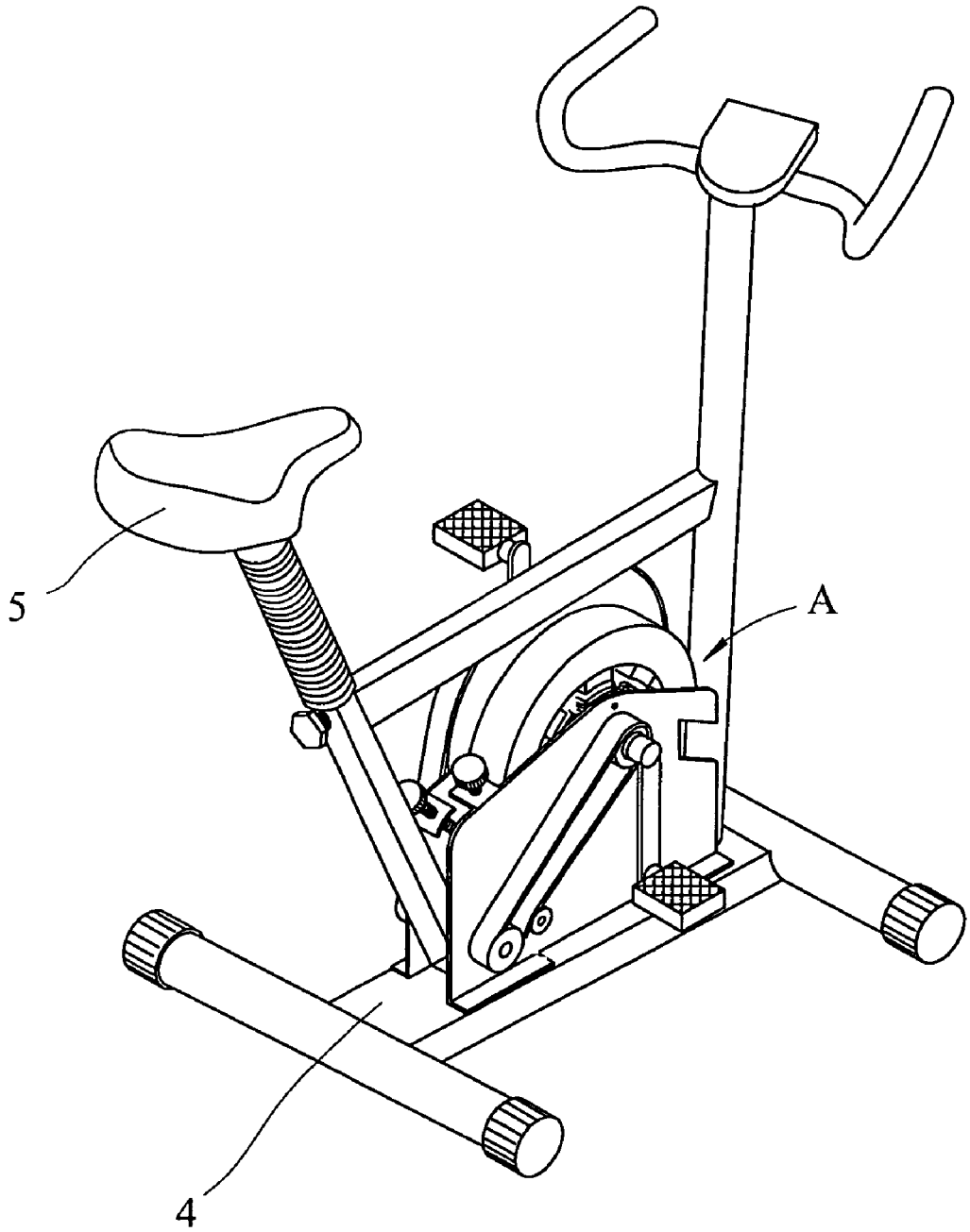
FIG. 6 is a perspective view to show a stationary bike with the driving and resistance device of the present invention.

As shown in FIG. 6, the driving and resistance device "A" is connected to a H-shaped base frame 4 of the stationary bike and a seat post and a front post are connected on the base frame 4. The driving and resistance device "A" is located between the seat post and the front post, wherein a seat 5 is connected to a top of the seat post and a control panel is connected to the top of the front post. The space that the stationary bike occupies can be reduced.

Figure 6A:
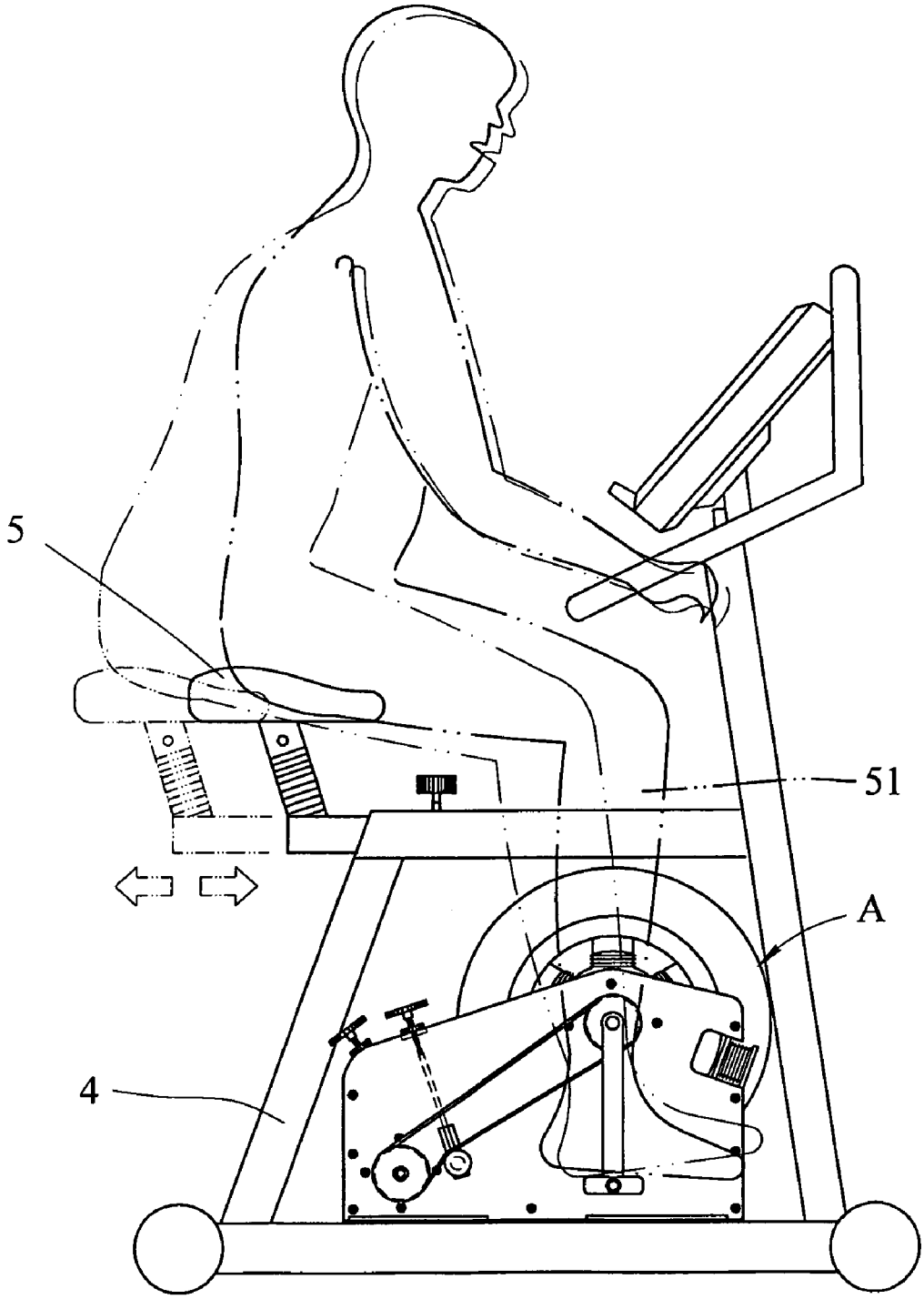
FIG. 6A shows another embodiment of the stationary bike with the driving and resistance device of the present invention.
Figure 7:
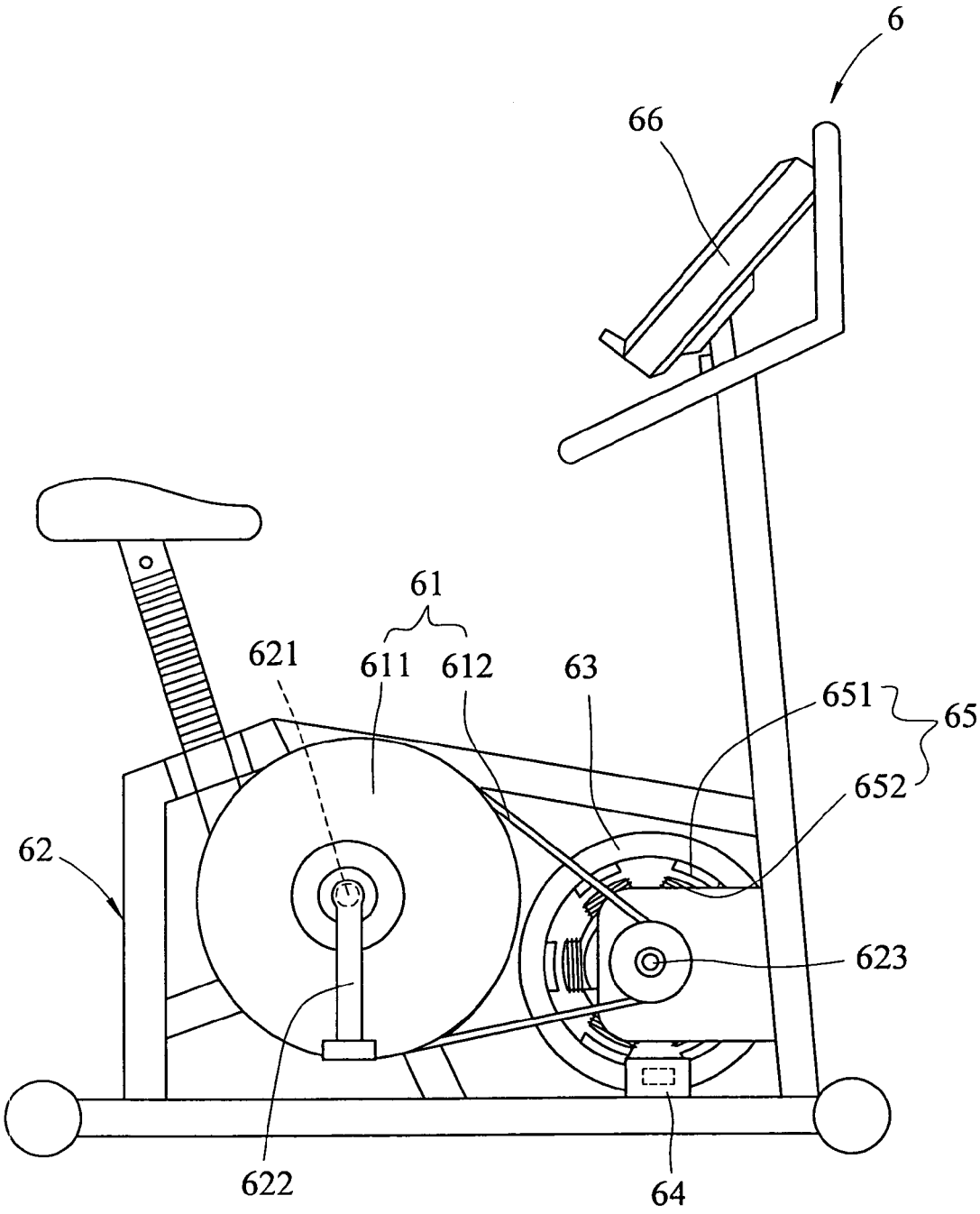
FIG. 7 PRIOR ART
FIG. 7 is a side view to show a stationary bike with a conventional driving and resistance device.

FIG. 6A shows another embodiment of the stationary bike wherein the seat 5 can be adjusted horizontally so that the user's legs are not interfered by the front post.

While we have shown and described the embodiment in accordance with the present invention, it should be clear to those skilled in the art that further embodiments may be made without departing from the scope of the present invention.

What is claimed is:

1. A driving and resistance device for stationary bikes, comprising:

a frame including two boards and a shaft extending through the two boards, two cranks connected to two ends of the shaft;

a flywheel connected to the shaft, and a driving unit including a driving wheel mounted to the shaft and driving the flywheel, the driving unit further including a first belt, a second belt, an idle wheel unit, an intermediate wheel unit and a passive wheel, the passive wheel connected to a sleeve which is secured to the shaft in a first direction, the driving wheel being driven by rotating the cranks and the first belt, the intermediate wheel unit, the second belt, the passive wheel and the sleeve and the flywheel being driven in sequence;

wherein the idle wheel unit includes two adjustment rods, two idle wheels and two side rods, the two adjustment rods extend through two extensions extending from the two boards and are connected to the two idle wheels, the two idle wheels include two axes which movably extend through slots defined through the two boards and the two axes are connected to the two adjustment rods respectively.

2. The device as claimed in claim 1, wherein a plurality of separation tubes connected between the two boards and the flywheel is located between the two boards.

3. The device as claimed in claim 2, wherein the shaft includes a disk connected to one end thereof, the driving wheel is mounted to the shaft and located between the disk and one of the boards.

4. The device as claimed in claim 1, wherein a magnetic resistance device is connected to the frame and located beside the flywheel.

5. The device as claimed in claim 4, wherein an electric power generation device is located in the flywheel and activated when the flywheel rotates.

6. The device as claimed in claim 5, wherein the electric power generation device includes a stator and a plurality of permanent magnets, the stator is fixed to the frame and the permanent magnets are located in a recess in the flywheel, the sleeve is fixed to the flywheel and rotates about the stator when the flywheel rotates.

7. The device as claimed in claim 1, wherein the extensions each have a threaded hole and the adjustment rods are threadedly connected to the threaded holes, each adjustment rod has an adjustment disk on a top end thereof so that when rotating the adjustment disks, the idle wheels are moved along the slots.

8. The device as claimed in claim 1, wherein the idle wheels press the first belt.

9. The device as claimed in claim 1, wherein the idle wheels press the second belt.

10. The device as claimed in claim 1, wherein a one-way bearing is located between the flywheel and the shaft such that the flywheel rotates in the first direction.

* * * * *